US011674349B2

(12) United States Patent
Grant et al.

(10) Patent No.: US 11,674,349 B2
(45) Date of Patent: Jun. 13, 2023

(54) SLIM PROFILE SAFE

(71) Applicant: NCR Corporation, Atlanta, GA (US)

(72) Inventors: Andrew Grant, Dunblane Scotland (GB); Ian Denny, Perth Scotland (GB)

(73) Assignee: NCR Corporation, Atlanta, GA (US)

( * ) Notice: Subject to any disclaimer, the term of this patent is extended or adjusted under 35 U.S.C. 154(b) by 430 days.

(21) Appl. No.: 16/896,855

(22) Filed: Jun. 9, 2020

(65) Prior Publication Data

US 2021/0381300 A1 Dec. 9, 2021

(51) Int. Cl.

| | |
|---|---|
| ***E05G 1/024*** | (2006.01) |
| ***E05G 1/026*** | (2006.01) |
| *G07F 19/00* | (2006.01) |

(52) U.S. Cl.

CPC ..... *E05G 1/024* (2013.01); *E05G 1/026* (2013.01); *E05G 2700/00* (2013.01); *G07F 19/20* (2013.01)

(58) Field of Classification Search

CPC ..... E05G 1/024; E05G 1/026; E05G 2700/00; E05G 1/02; E05G 1/04; E05G 7/001; E05G 2700/02; G07F 19/20; G07D 11/25; Y10S 902/09; Y10T 70/5031; Y10T 70/5544; Y10T 70/5549; Y10T 70/5553; Y10T 70/5558

USPC ..... 232/15, 16; 109/24.1, 46, 47, 55, 59 R, 109/59 T, 64, 66; 194/350; 902/9, 33

See application file for complete search history.

(56) References Cited

U.S. PATENT DOCUMENTS 4,706,577 A * 11/1987 Jones ..... G07F 19/205 109/42
4,917,022 A * 4/1990 Ogasawara ..... E05B 47/0012 109/43
5,860,302 A * 1/1999 James ..... E05C 19/06 70/168
6,595,606 B1 * 7/2003 Gunst ..... G07F 19/205 109/24.1
7,165,767 B2 * 1/2007 Graef ..... G07F 19/205 271/145
8,353,449 B1 * 1/2013 Davis ..... G07F 19/205 235/491
8,485,113 B2 * 7/2013 Hannon ..... G07F 19/205 52/294

(Continued)

FOREIGN PATENT DOCUMENTS

EP 2372068 A2 * 10/2011

OTHER PUBLICATIONS

EP Search Report.

*Primary Examiner* — Suzanne L Barrett
(74) *Attorney, Agent, or Firm* — Notaro, Michalos & Zaccaria P.C.; John S. Economou

(57) ABSTRACT

A slim-profile safe has a safe body that defines an interior space, and a safe door that is moveable between a closed position for securing the interior space and an open position for accessing the interior space. The safe door includes a fore portion and a recess portion that is offset from the fore portion by a recess angle. The fore portion defines a maximum depth of the safe, and the recess portion provides a reduced depth portion of the safe for the presentation of external hardware for operating a lock that releasably locks the safe door in the closed position, the recess portion being sufficiently offset from the fore portion such that the external hardware is positioned entirely sub-flush to a plane that extends parallel to the fore portion.

15 Claims, 6 Drawing Sheets

(56) References Cited

U.S. PATENT DOCUMENTS

| | | | | |
|---|---|---|---|---|
| 8,651,367 | B1 * | 2/2014 | Spencer | A45C 15/06 109/66 |
| 8,950,223 | B1 * | 2/2015 | Joyce | A45C 15/06 70/159 |
| 9,429,389 | B1 * | 8/2016 | Brewer | E05B 65/52 |
| 10,636,258 | B1 * | 4/2020 | Mercer | G07F 19/203 |
| 2004/0145106 | A1 | 7/2004 | Graef et al. | |
| 2007/0018541 | A1 | 1/2007 | Hacker et al. | |
| 2010/0242810 | A1 * | 9/2010 | Todd | E05G 1/08 109/59 R |
| 2011/0079056 | A1 * | 4/2011 | Sakai | E05B 67/22 70/52 |
| 2011/0100074 | A1 * | 5/2011 | Meekma | E05B 19/0005 70/63 |
| 2011/0203328 | A1 * | 8/2011 | Vilkomirski | E05B 47/0657 70/57.1 |
| 2013/0099641 | A1 * | 4/2013 | Saucier | A47G 29/10 312/326 |
| 2013/0233211 | A1 * | 9/2013 | Tavares de Pinho | E05G 1/024 109/51 |
| 2015/0343958 | A1 * | 12/2015 | McGoldrick | E05G 1/04 29/428 |
| 2017/0130513 | A1 * | 5/2017 | Smith | A47B 81/002 |

* cited by examiner

PRIOR ART

SLIM PROFILE SAFE

FIELD OF THE INVENTION

The present invention is inclusive of a slim-profile safe, automated teller machines (ATMs) that include such safes, and self-service banking facilities that incorporate such ATMs and safes, for example, in the form of a drive-up banking system.

BACKGROUND OF THE INVENTION

Banking facilities have long offered drive-up banking services whereby customers may conduct financial transactions while remaining seated in their vehicles. Drive-up banking services are commonly provided through use of a pneumatic transfer system 1, such as that shown in FIG. 1, in which a carrier for transporting financial articles is transferred between a customer and a teller via a pneumatic tube. One advantage of a pneumatic transfer system is that an external user-interface portion 10 thereof requires only a limited footprint at an external site outside the banking facility. This is advantageous as it maximizes the usage of space at the external site, such that multiple traffic lanes 20 may be provided, each with a dedicated user-interface portion 10 positioned at a relatively narrow island platform 25, enabling simultaneous financial transactions and promoting a greater number of financial transactions in total.

In recent years, there has been a preference for ATMs over pneumatic transfer systems. ATMs are considered more profitable and more convenient in that they provide generally unattended, around-the-clock service to customers. In addition, the hardware required for ATMs can be more cost-effective over the long term as it is subject to less wear-and-tear than hardware required for pneumatic transfer systems. As a result there has been an increase in demand for ATM drive-up banking systems over pneumatic drive-up banking systems, and there has been a corresponding movement to replace existing pneumatic drive-up banking systems with ATM drive-up banking systems.

However, the use of ATMs in drive-up banking systems presents a complication in that the hardware for an ATM traditionally requires a greater footprint than that required for a user-interface portion 10 of a pneumatic transfer system 1. This is due to conventional ATMs having a limited minimal footprint based on the dimensions of the conventional internal safe therein that stores currency used by the ATM—the internal safe itself having a limited minimal footprint based on the components thereof that are necessary for the automated handling and storage of currency (e.g., a note module). A user-interface portion 10 of a pneumatic transfer system 1 is not limited by these factors, as there is no need for an internal safe at a user-interface portion 10 since financial articles are instead conveyed between the user and a teller located inside the banking facility.

Due to the minimal footprint limitations, a conventional ATM 2, such as that seen in FIG. 2, necessarily requires a relatively larger island platform 25 than otherwise required for a user-interface portion 10 of a pneumatic transfer system 1. This may be seen from a comparison of FIGS. 1-2, where it can be seen that the island platform 25 used for the ATM 2 has a width $W_2$ that is greater than the width $W_1$ ($W_2>W_1$) of the island platform 25 used for the interface portion 10 of the pneumatic transfer system 1. As a result, drive-up banking systems constructed with conventional ATMs 2 require larger external sites and may be limited to a reduced number of traffic lanes 20 than would otherwise be available with use of pneumatic transfer systems. Similarly, when replacing an existing pneumatic drive-up banking system with an ATM drive-up banking system, it may be necessary to remove pre-existing traffic lanes 20 to accommodate the extra space needed for the larger island platforms 25 required by conventional ATMs 2, and in some instances it may even be necessary to reconstruct the entire external site to install larger island platforms 25 and re-position traffic lanes 20 altogether.

Accordingly there is a need in the art for an ATM having a reduced minimal footprint, so as to lessen spacing restrictions for ATMs in drive-up banking systems and to simplify retrofitting of existing drive-up banking systems when replacing pneumatic transfer systems with ATMs.

SUMMARY OF THE INVENTION

A slim-profile safe has a safe body that defines an interior space, and a safe door that is moveable between a closed position for securing the interior space and an open position for accessing the interior space. The safe door includes a fore portion and a recess portion. The fore portion of the safe door may include a planar outer surface that is parallel to the back wall of the safe body, while the recess portion may include a planar outer surface that is offset from the planar surface of the fore portion by a recess angle, with the recess angle being defined by an edge or curved surface between the fore and recess portions.

When the safe door is in the closed position, a maximum depth of the safe is defined by a forward-most surface of the safe door and the outer surface of the back wall of the safe body, while the recess portion of the safe door provides a reduced depth portion of the safe, as also measured from the outer surface of the back wall of the safe body. External hardware for operating a lock for releasably locking the safe door in the closed position is provided at the recess portion of the safe door, and the recess portion is sufficiently offset from the fore portion such that the external hardware is positioned entirely sub-flush to a plane that extends parallel to the planar surface of the fore portion.

The safe body includes a first side wall to which the safe door is rotatably mounted, and a second side wall adapted to matingly engage a lock on the safe door for releasably locking the safe door in the closed position. The lengths of the first and second side walls of the safe body differ from one another, based on the recess configuration of the safe door, with the second side wall having a length that is shorter than a length of the first side wall, as measured relative to the back wall of the safe body.

A note slot is formed in the top wall of the safe body, proximate to a forward edge thereof. The note slot may be formed with a forward lip having a strength-enhancing composition and/or a reinforced structure for enhancing the structural integrity of the safe body at that location. Alternatively, the note slot may be formed as an open cavity that opens toward a forward edge of the top wall of the safe body, without a forward lip, and the safe door is formed with an upper ledge having a rearward protrusion that is dimensioned to complement the open cavity configuration of the note slot and to serve as a forward lip to the note slot.

The present invention is also inclusive of automated teller machines (ATMs) that incorporate a slim profile safe according to the present invention, as well as methods of making such slim profile safes and ATMs. The methods include forming a safe door having the fore and recess portions, rotatably mounting the recessed safe door to a safe body, and installing the slim profile safe in an ATM housing together with a note handling unit.

The present invention is further inclusive of methods of retro-fitting a drive-up banking system, which include removing from the drive-up banking system a pre-existing financial transaction system, such as a pneumatic transfer system, and substituting in place thereof an ATM according to the present invention. These methods further include making such substitutions without altering the dimensions of pre-existing platforms for supporting user-interface portions of the pre-existing financial transaction system and/or without altering the dimensions or number of traffic lanes at an external site of the drive-up banking system.

Both the foregoing general description and the following detailed description are exemplary and explanatory only and are intended to provide further explanation of the invention as claimed. The accompanying drawings are included to provide a further understanding of the invention; are incorporated in and constitute part of this specification; illustrate embodiments of the invention; and, together with the description, serve to explain the principles of the invention.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
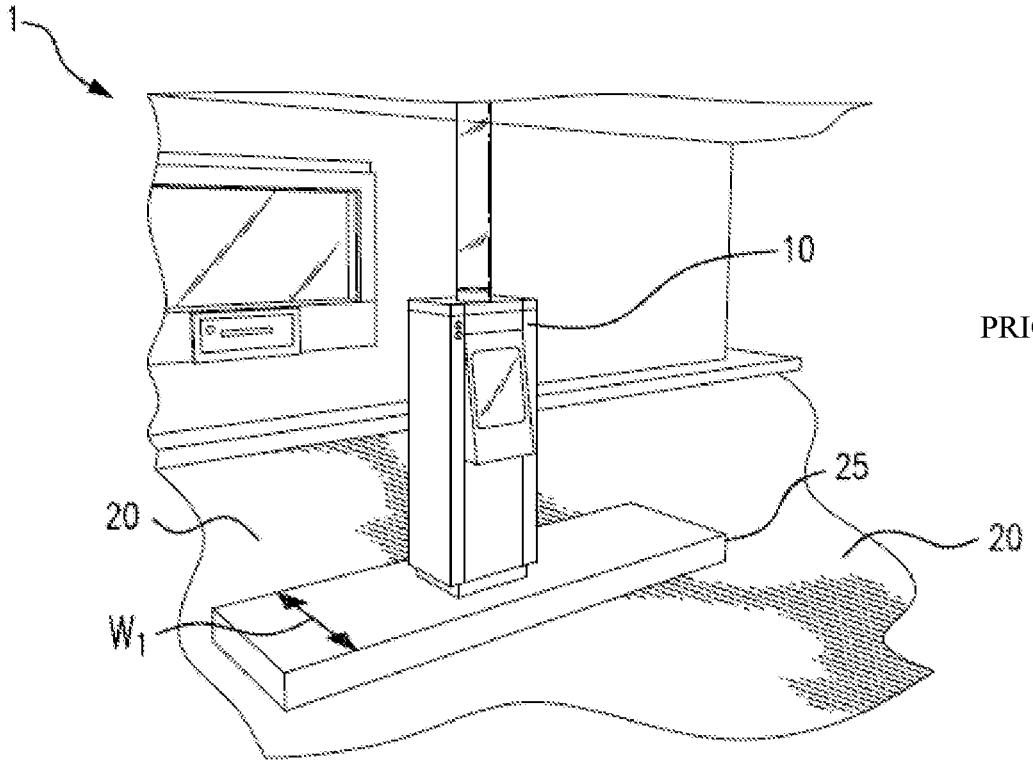
FIG. 1 shows a conventional pneumatic transfer system in a drive-up banking facility.
Figure 2:
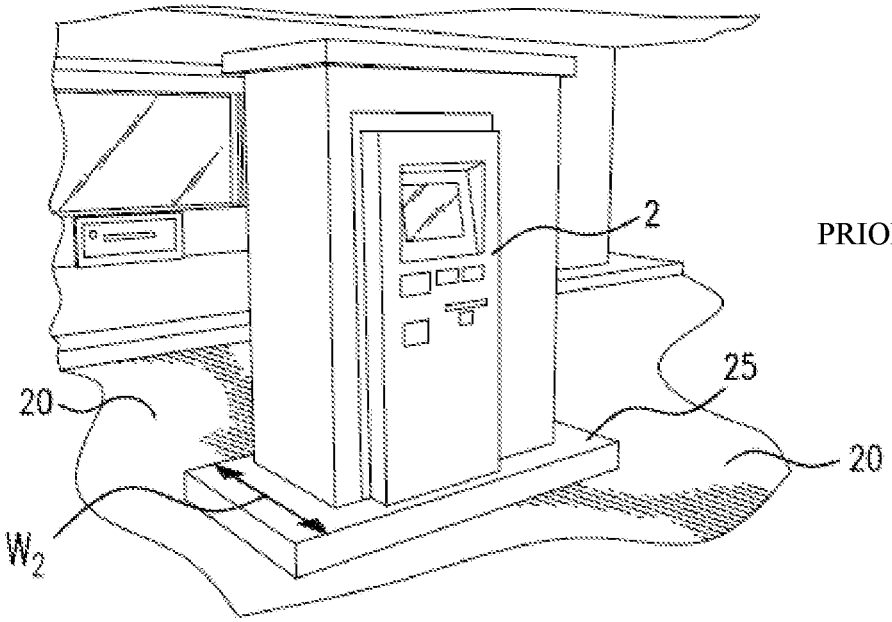
PRIOR ART FIG. 2
FIG. 2 shows a conventional automated teller machine (ATM) in a drive-up banking facility.

The following disclosure discusses the present invention with reference to the examples shown in the accompanying drawings, though does not limit the invention to those examples.

The use of any and all examples, or exemplary language (e.g., "such as") provided herein is intended merely to better illuminate the invention and does not pose a limitation on the scope of the invention unless otherwise claimed. No language in the specification should be construed as indicating any non-claimed element as essential or otherwise critical to the practice of the invention. Unless made clear in context, As used herein, the singular forms "a," "an," and "the" include plural referents unless the context clearly dictates otherwise. Unless indicated otherwise by context, the term "or" is to be understood as an inclusive "or." Terms such as "first", "second", "third", etc. when used to describe multiple devices or elements, are so used only to convey the relative actions, positioning and/or functions of the separate devices, and do not necessitate either a specific order for such devices or elements, or any specific quantity or ranking of such devices or elements.

Use of the terms "about" or "approximately" are intended to describe values above and/or below a stated value or range, as would be understood by one having ordinary skill in the art in the respective context. In some instances, this may encompass values in a range of approx. +/−10%; in other instances there may be encompassed values in a range of approx. +/−5%; in yet other instances values in a range of approx. +/−2% may be encompassed; and in yet further instances, this may encompass values in a range of approx. +/−1%.

It will be understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless indicated herein or otherwise clearly contradicted by context.

Recitations of a value range herein, unless indicated otherwise, serves as a shorthand for referring individually to each separate value falling within the stated range, including the endpoints of the range, each separate value within the range, and all intermediate ranges subsumed by the overall range, with each incorporated into the specification as if individually recited herein.

Unless indicated otherwise, or clearly contradicted by context, methods described herein can be performed with the individual steps executed in any suitable order, including: the precise order disclosed, without any intermediate steps or with one or more further steps interposed between the disclosed steps; with the disclosed steps performed in an order other than the exact order disclosed; with one or more steps performed simultaneously; and with one or more disclosed steps omitted.

The present invention is inclusive of a slim profile safe that is suitably dimensioned to house internal components necessary for automating the handling and storage of currency while also reducing the external dimensions of the safe body, as well as reduced footprint ATMs and financial transaction systems that incorporate such slim profile safes, and methods of making and using each of the foregoing.

Figure 3:
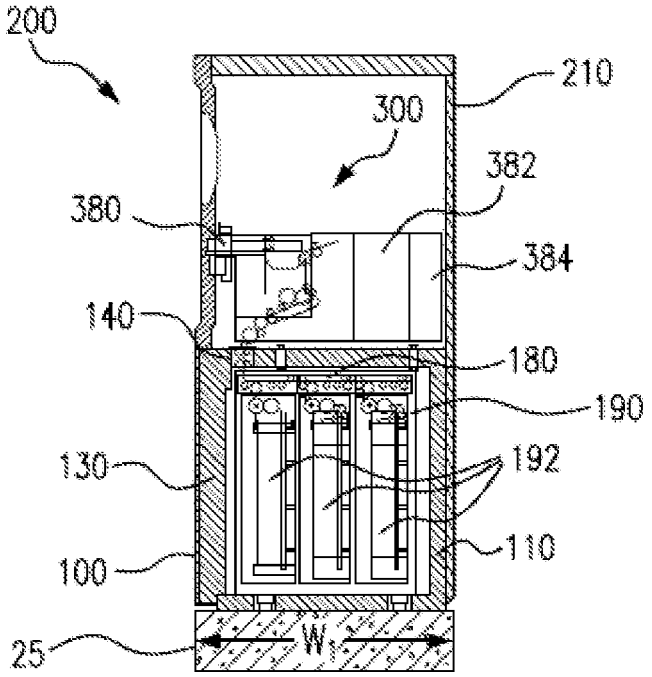
FIG. 3 shows a cross-sectional view of an ATM according to the present invention.
Figure 4:
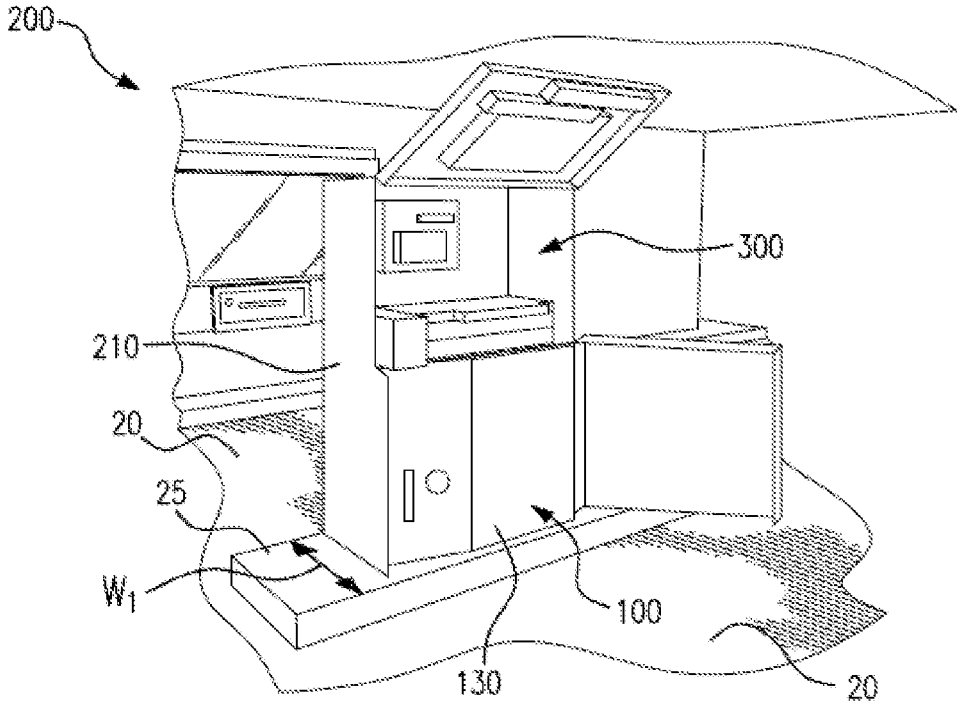
FIG. 4 shows a perspective view of the ATM in FIG. 3.

FIGS. 3-4 show an ATM 200 according to the present invention, comprising a housing 210 in which there is stored a note handling unit 300 and a safe 100. The note handling unit 300 includes a primary note conveyance system 380 that communicates with a secondary note conveyance system 180 in the safe 100 for delivering notes for storage within the safe 100, and for dispensing stored notes therefrom. The note handling unit 300 further includes a validation system 382 for validating the authenticity of notes, and an exception storage 384 for storing notes that fail validation.

As seen in FIGS. 5-9, the safe 100 comprises a safe body 110 having a base 111, a back wall 112, two side walls 113/114, and a top wall 115 that define an interior space 120. A door 130 is provided at a front of the safe 100 opposite the back wall 112, the door 130 being moveable between closed and open positions for securing and granting access to the interior space 120. At least one note module 190 is housed in the interior space 120 of the safe 100, the note module 190 having one or more cassettes 192 for receiving, storing, and recycling notes. A note slot 140 is provided proximate to a forward edge of the top wall 115 of the safe body 110, and aligned to facilitate passage of notes between the primary and secondary conveyance systems 380/180. The note conveyance systems 380/180 are provided, generally, in the form of conveyors with the secondary note conveyance system 180 adapted to transfer notes received from the primary note conveyance system 380 to the one or more cassettes 192 for storage, and to transfer notes from the one or more cassettes 192 to the primary note conveyance system 380 for dispensing from the ATM 200.

Figure 5:
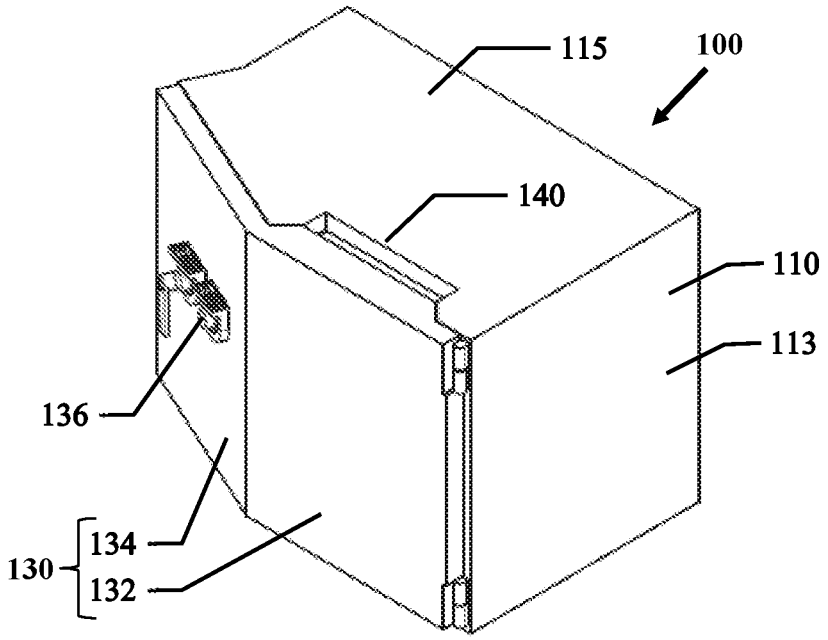
FIG. 5 shows a first perspective view of the safe in the ATM of FIG. 3.
Figure 6:
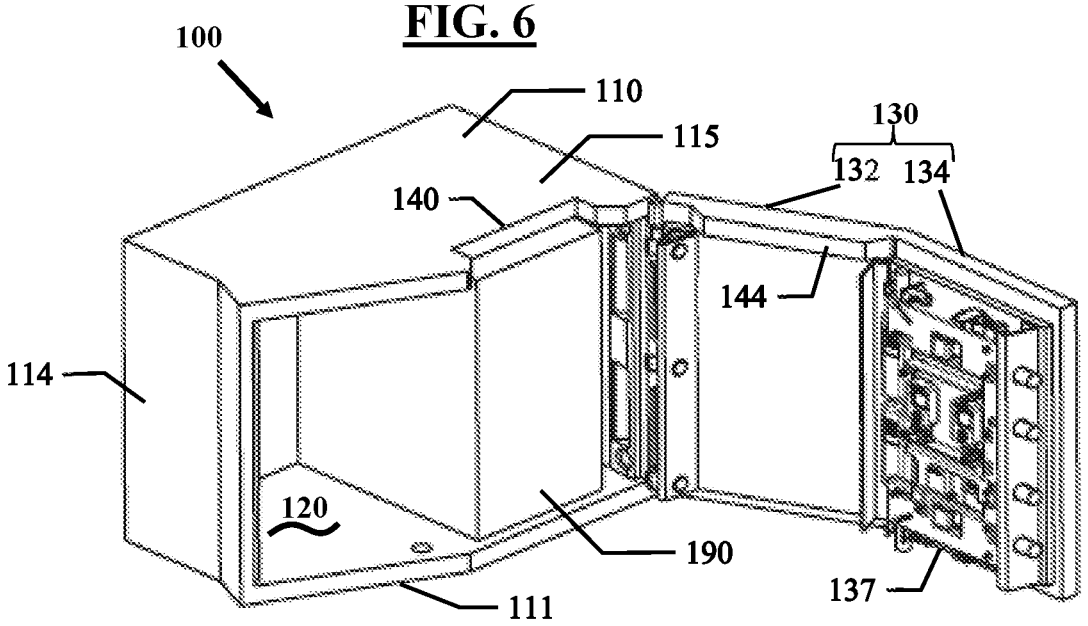
FIG. 6 shows a second perspective view of the safe in the ATM of FIG. 3.

As seen in FIGS. 5-6, the safe door 130 is provided with a recessed configuration having a fore portion 132 and a recessed portion 134, with external hardware 136 protruding from an exterior surface of the recessed portion 134 for operating a lock 137 that releasably locks the door 130 in the closed position. In the illustrated example the external hardware 136 is inclusive of a handle and two combination locks, though it will be understood that the external hardware 136 is not limited thereto, and may include additional and/or alternative hardware components.

Figure 7A:
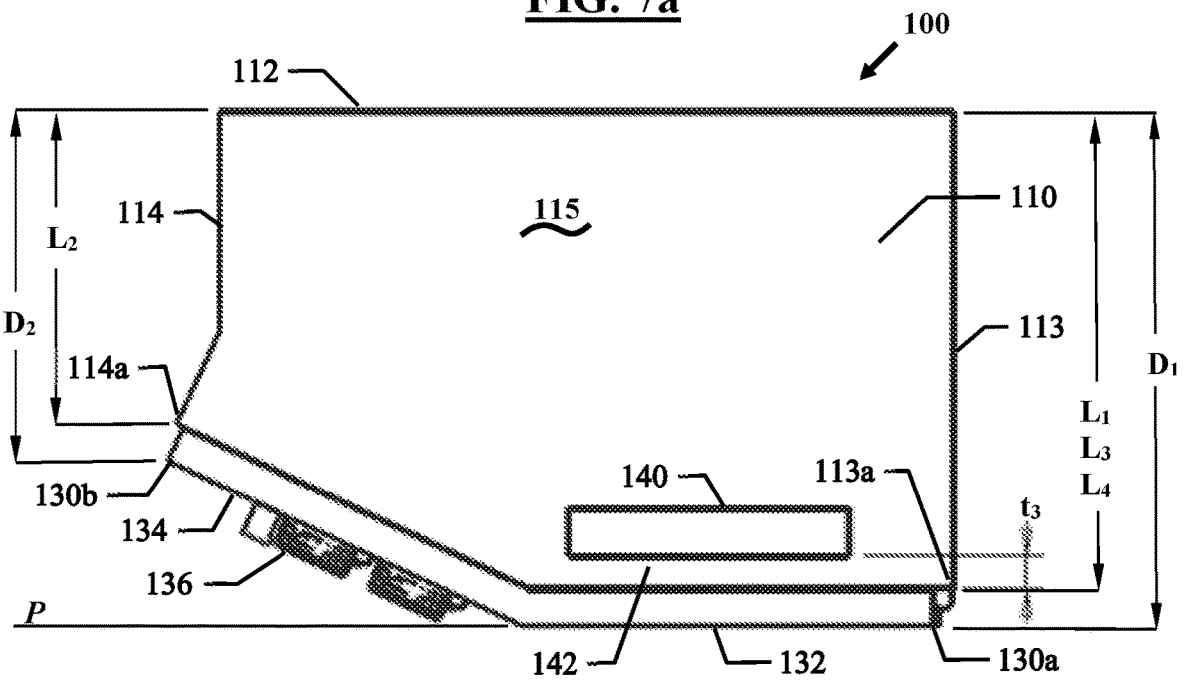
FIG. 7*a* shows a first top plan view of the safe in the ATM of FIG. 3, with a first construction.

As illustrated in FIG. 7*a*, the recess portion 134 is provided as a chamfered surface that is sufficiently offset from the fore portion 132 to ensure that all external hardware 136 is positioned entirely sub-flush to a plane P that extends perpendicular to the side wall 113 to which the safe door 130 is rotatably mounted, when the safe door 130 is in the closed position; the plane P being level with and parallel to a forward-most exterior surface of the fore portion 132. In this way, the recessed safe door 130 is configured such that, when in a closed position, a first end 130*a* thereof, at the fore portion 132, is located a first distance $D_1$ forward of the back wall 112 while a second end 130*b* thereof, at the recess portion 134, is located a second distance $D_2$ forward of back wall 112, the second distance $D_2$ being less than the first distance $D_1$($D_2<D_1$).

Figure 8A:
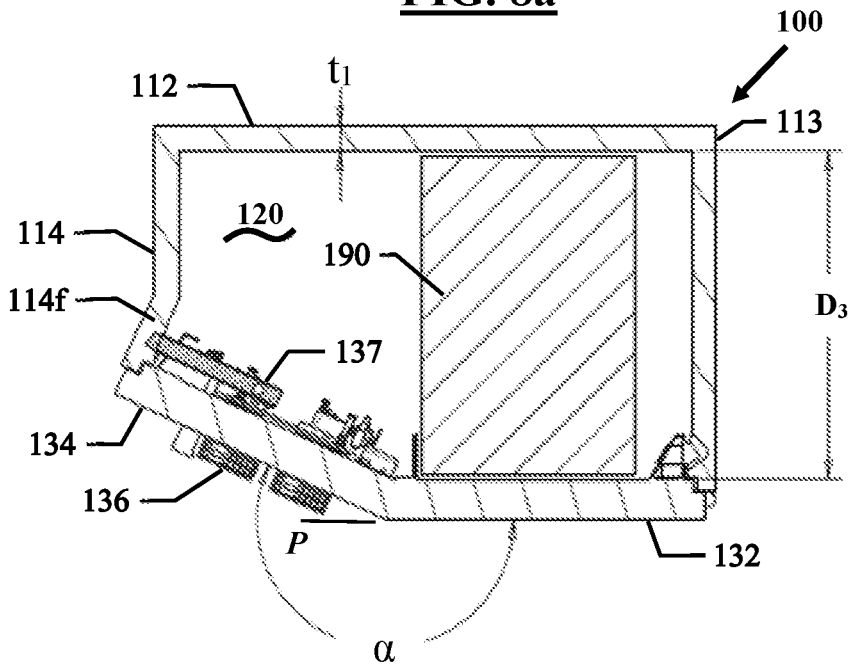
FIG. 8*a* shows a top cross-sectional view of the safe in FIG. 5.

As illustrated in FIG. 8*a*, the recess portion 134 is oriented at a recess angle $\alpha$ relative to the plane P (which also corresponds in this instance with the planar surface of the fore portion 132, oriented orthogonally to the side wall 113), with the fore and recess portions 132/134 meeting at an edge that defines the recess angle $\alpha$. However, the recessed door 130 may also be configured such that the fore and recess portions 132/134 meet at a curved surface (in place of an edge).

FIG. 8*a* shows the safe 100 with a recess angle $\alpha$ of approximately 205°. However, the recess angle $\alpha$, whether defined by an edge or a curved surface, may range from greater than 180° to 270° (180°<$\alpha$<270°), provided that the angle is sufficient to offset all external hardware 136 to reside entirely sub-flush to the plane P. The recess angle $\alpha$ may vary with the size of the external hardware 136, with relatively lesser angles available for constructions with relatively low-profile hardware and relatively larger angles needed for constructions with relatively large-profile hardware.

As seen in FIG. 7*a*, the side walls 113/114 are made to have respective lengths $L_1$/$L_2$, as measured from the back wall 112 to forward ends 113*a*/114*a* of the respective walls. So as to accommodate the recess portion 134 of the safe door 130, the length $L_2$ of side wall 114 is made to be shorter than the length $L_1$ of the side wall 113, with the relative difference in lengths being dependent on the recess angle $\alpha$. A relatively lesser recess angle $\alpha$ will result in a relatively longer length $L_2$ of side wall 114, while a relatively greater recess angle $\alpha$ will result in a relatively shorter length $L_2$ of side wall 114.

Figure 8B:
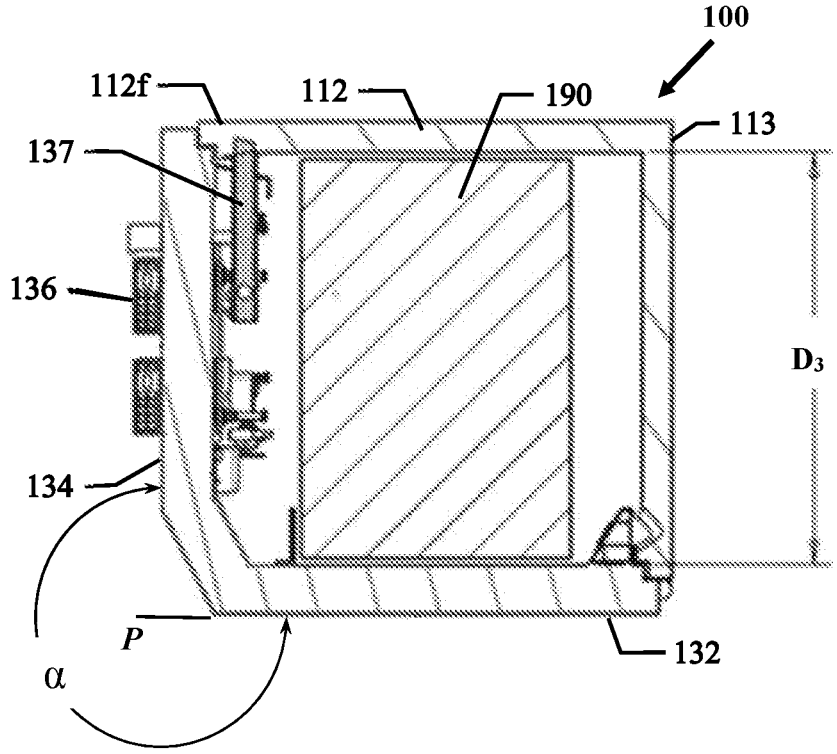
FIG. 8*b* shows a top cross-section view of a safe according to the present invention, with an alternate configuration.
Figure 9:
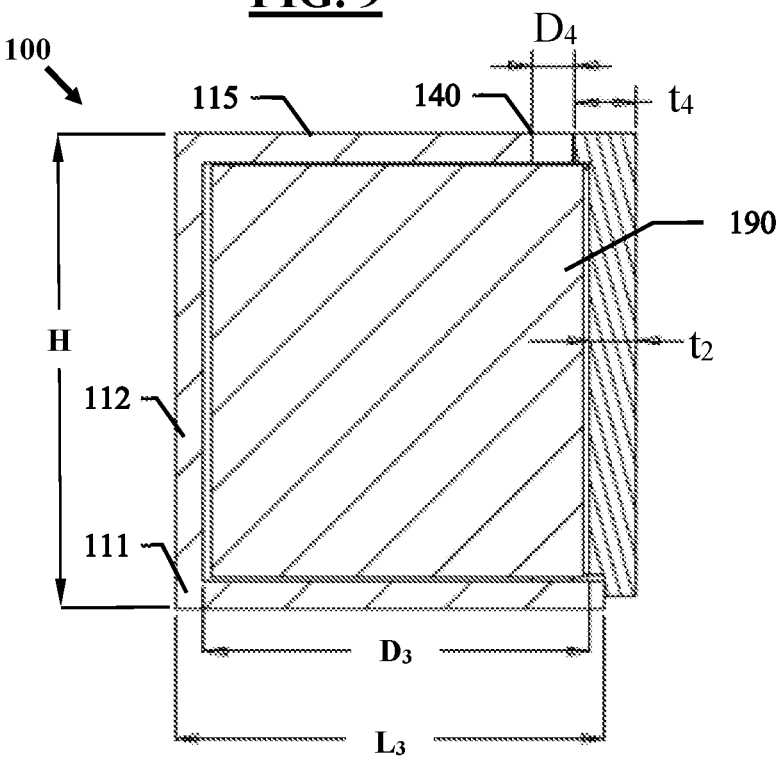
FIG. 9 shows a left-side cross-sectional view of the safe in FIG. 5.

As seen in FIG. 8*a*, side wall 114 is provided with a flanged portion 114*f* that is adapted to matingly engage the lock 137 on the safe door 130. Though the figures show the flanged portion 114*f* as protruding in a generally outward direction from the side wall 114 (away from interior space 120), the flanged portion 114*f* may instead protrude in a generally inward direction (toward interior space 120). In some instances the recessed door 130 may be provided with a recess angle $\alpha$ of 270° between the fore and recess portions 132/134, such that when the recessed door 130 is in a closed position the recess portion 134 aligns flush with the side wall 114, or resides in place of the side wall 114, with external hardware 136 protruding orthogonal to the plane P. In one such example, as shown in FIG. 8*b*, the side wall 114 may be omitted in its entirety, and the lock 137 may instead engage with a mating structure provided at an interior surface of a flanged portion 112*f* at the back wall 112 of the safe body 100.

A safe 100 according to the present invention may be further reduced in depth by reducing the lengths $L_1$-$L_4$ of the side walls 113/114, base 111, and top wall 115, as each measured forward of the back wall 112, to only that which is essential for accommodating the note module 190 in the interior space 120, as aligned with the fore portion 132 of the safe door 130. However, due to the positioning of the note module 190 within the interior space 120, and the corresponding positioning of the note slot 140 on the top wall 115, a reduction in the length $L_4$ of the top wall 115 may result in a forward lip 142 of the note slot 140 being formed with a reduced thickness $t_3$, as seen in FIG. 7*a*, which may weaken the structural integrity of the safe body 100 at that location. To address this, the forward lip 142 may be formed with a strength-enhancing composition (e.g., Alloy Steel) and/or a reinforced structure (e.g., inclusion of hardened steel plates).

Figure 7B:
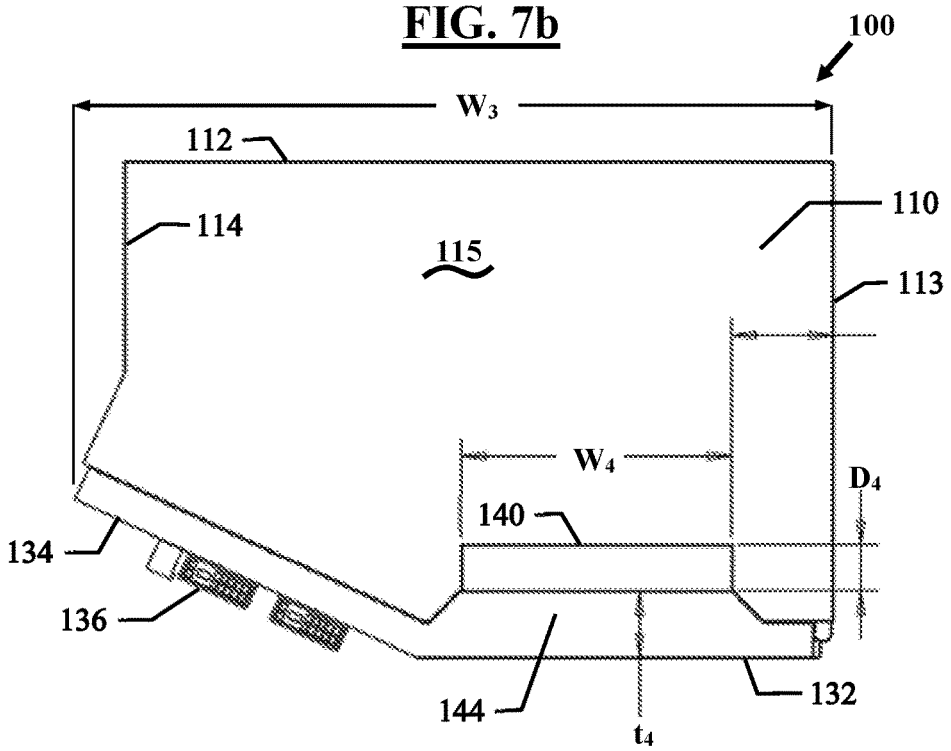
FIG. 7*b* shows a second top plan view of the safe in the ATM of FIG. 3, with a second construction.

Alternatively, as seen in FIG. 7*b*, the safe body 100 may be constructed with the note slot 140 in the form of an open cavity, without a forward lip, and the safe door 130 may instead be constructed with an upper ledge having a rearward protrusion 144 that is dimensioned to complement the open cavity configuration of the note slot 140, and which extends sufficiently rearward of the door 130 to protrude into the open cavity formation, so as to serve as a forward lip to the note slot 140.

As one working example of a slim profile safe 100 according to the present invention, the safe body 110 is constructed with a base 111, a back wall 112, side walls 113/114, and a top wall 115 each having a thickness $t_1$ of approximately 40.00 mm, while the safe door 130 is made with a thickness $t_2$ of approximately 45-65.00 mm. A maximum depth $D_1$ of the safe 100, from a rear surface of the back wall 112 to a forward-most point of safe door 130, at the fore portion 132, measures approximately 645.00 mm; while a maximum width $W_3$ of the safe 100 measures approximately 984.64 mm. The safe 100 has a total height H, from an outer surface of the base 111 to an outer surface of the top wall 115, measuring approximately 668.00 mm. Internally, a maximum depth $D_3$ of the interior space 120, from an inner surface of the back wall 112 to an inner surface of the fore portion 132 of the door 130, measures approximately 540.00 mm.

In this example, both the fore and recess portions 132/134 of the door 130 are formed as planar surfaces offset by a recess angle $\alpha$ of approximately 205°. The note slot 140 formed in the top wall 115 of the safe body 110 forms an open cavity having a width W4 of approximately 350.00 mm, and a depth D4 of approximately 60.00 mm. In a first variation (FIG. 7*a*) the safe body 110 is constructed with a forward lip 142 to the note slot 140 having a thickness $t_3$ of approximately 20-40.00 mm. In a second variation (FIG. 7*b*), the note slot 140 is formed in an open cavity configuration, without a forward lip, and the safe door 130 is constructed with a rearward protrusion 144 dimensioned to complement the open cavity construction to serve as a forward lip to the note slot 140, when the door 130 is in the closed position, with the rearward protrusion having a thickness t4 of approximately 67-87.00 mm. Preferably, when using an open cavity construction for the note slot 140, the top wall 115 is provided with chamfered edges around the open cavity formation, and the rearward protrusion 144 is provided with corresponding chamfered surfaces so as to facilitate a flush alignment of the rearward protrusion 144 with the note slot 140.

When incorporating the slim profile safe 100, the ATM 200 shown in FIGS. 3-4 may be made with a reduced depth $W_1$, measuring approximately 660.00 mm, thereby yielding a minimal footprint that enables the ATM 200 to be positioned at a relatively narrow island platform 25, such as those used for positioning the user-interface portion 10 of the pneumatic transfer system 1, as seen in FIG. 1.

An ATM 200 according to the present invention, with inclusion of a safe 100 according to the present invention, may be incorporated into newly constructed drive-up banking system at banking facilities with the resulting drive-up banking system then requiring less space at the external site and/or enabling the construction of a greater number of traffic lanes at the external site.

ATMs 200 according to the present invention may also be used for retro-fitting pre-existing drive-up banking systems, for example, by substituting such ATMs 200 for pre-existing pneumatic transfer systems 1 in drive-up banking systems. Advantageously, due to the minimal footprint of an ATM 200 according to the present invention, such retro-fitting may be accomplished by positioning ATMs 200 at the same island platforms 25 that were used for the user-interface portions 10 of a pneumatic transfer system 1. As a result, there may be avoided any need to entirely reconstruct the external site for the drive-up banking system, as well as avoiding any need to re-dimension the island platforms 25 or the traffic lanes 20 at the external site.

Although the present invention is described with reference to particular embodiments, it will be understood to those skilled in the art that the foregoing disclosure addresses exemplary embodiments only; that the scope of the invention is not limited to the disclosed embodiments; and that the scope of the invention may encompass additional embodiments embracing various changes and modifications relative to the examples disclosed herein without departing from the scope of the invention as defined in the appended claims and equivalents thereto.

To the extent necessary to understand or complete the disclosure of the present invention, all publications, patents, and patent applications mentioned herein are expressly incorporated by reference herein to the same extent as though each were individually so incorporated. No license, express or implied, is granted to any patent incorporated herein.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

The present invention is not limited to the exemplary embodiments illustrated herein, but is instead characterized by the appended claims.

What is claimed is:

1. A safe, comprising:

a safe body defining an interior space, the safe body having a back wall, a first side wall and a second side wall, a length of the second side wall, as measured from the back wall to a forward edge of the second side wall, being less than a length of the first side wall, as measured from the back wall to a forward edge of the first side wall, at least a portion of the second side wall being parallel to the first side wall; and a safe door that is moveable between a closed position for securing the interior space and an open position for accessing the interior space, the safe door comprising a fore portion and a recess portion, the recess portion being non-parallel to the back wall of the safe body when the safe door is in the closed position, wherein the fore portion of the safe door defines a first depth, as measured between a forward-most point of the fore portion and a back wall of the safe body when the safe door is in the closed position, and the recess portion of the safe door defines a second depth, as measured between a rear-most point of the recess portion and the back wall of the safe body when the safe door is in the closed position, the second depth being less than the first depth and wherein the fore portion of the safe door comprises a planar outer surface that is parallel to the back wall of the safe body.

2. The safe according to claim 1, wherein the recess portion of the safe door comprises a planar outer surface that is oriented at a recess angle relative to the planar outer surface of the fore portion.

3. The safe according to claim 2, wherein the recess portion and the fore portion meet at an edge that defines the recess angle.

4. The safe according to claim 2, wherein external hardware for operating a lock for releasably locking the safe door in the closed position is provided at the recess portion of the safe door, and the recess portion is sufficiently offset from the fore portion such that the external hardware is positioned entirely sub-flush to a plane that extends parallel to the planar surface of the fore portion.

5. The safe according to claim 1, wherein the safe door being rotatably mounted to the first side wall, and the second side wall being adapted to engage a lock on the safe door for releasably locking the safe door in the closed position.

6. The safe according to claim 1, wherein a note slot is formed in a top wall of the safe body, proximate a forward edge of the top wall.

7. The safe according to claim 6, wherein the note slot comprises a forward lip formed in the top wall of the safe body, the forward lip being formed of a strength-enhancing composition.

8. The safe according to claim 6, wherein the note slot comprises a forward lip formed in the top wall of the safe body, the forward lip being constructed with a reinforced structure.

9. The safe according to claim 6, wherein the note slot is formed as an open cavity that opens toward a forward edge of the top wall of the safe body, without a forward lip, and the safe door is formed with an upper ledge having a rearward protrusion that is dimensioned to complement the open cavity configuration of the note slot and to serve as a forward lip to the note slot.

10. A method of making a safe according to claim 1, comprising forming the safe door as a recessed door having the fore portion and the recess portion.

11. The method according to claim 10, further comprising rotatably mounting the safe door to a safe body.

12. An automated teller machine comprising a safe according to claim 1.

13. A method of making an automated teller machine, comprising installing a safe according to claim 1 in a housing together with a note handling unit.

14. A method of retro-fitting a drive-up banking system, comprising removing from the drive-up banking system a pre-existing financial transaction system, and substituting an automated teller machine according to claim 12 in place of the removed financial transaction system.

15. The safe according to claim 1, wherein the second sidewall includes a flanged portion adapted to matingly engage a lock on the safe door.

* * * * *